US007281343B2

(12) United States Patent
Riha et al.

(10) Patent No.: US 7,281,343 B2
(45) Date of Patent: Oct. 16, 2007

(54) FOOTWEAR OUTSOLE

(75) Inventors: Thomas F. Riha, East Grand Rapids, MI (US); Roy S. Hayes, Kentwood, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 419 days.

(21) Appl. No.: 10/899,286

(22) Filed: Jul. 26, 2004

(65) Prior Publication Data

US 2006/0016100 A1 Jan. 26, 2006

(51) Int. Cl.
*A43B 15/00* (2006.01)

(52) U.S. Cl. ..... 36/59 C; 36/25 R; 36/103; 36/59 R; D2/953; D2/960

(58) Field of Classification Search ..... 36/59 C, 36/25 R, 103; D2/953, 951, 960
See application file for complete search history.

(56) References Cited

U.S. PATENT DOCUMENTS 2,833,057 A * 5/1958 Hack ..... 36/59 C
3,006,085 A * 10/1961 Bingham, Jr. ..... 36/59 C
3,018,571 A * 1/1962 Doherty ..... 36/59 C
D378,240 S * 3/1997 Merceron ..... D2/953
D426,947 S * 6/2000 Pollastrelli ..... D2/956
D460,607 S * 7/2002 Pollastrelli ..... D2/954
D461,295 S * 8/2002 Pollastrelli ..... D2/953
7,225,564 B1 * 6/2007 Gillespie ..... 36/112

* cited by examiner

*Primary Examiner*—Jila M Mohandesi
(74) *Attorney, Agent, or Firm*—Warner Norcross & Judd LLP

(57) ABSTRACT

An outsole having a plurality of traction elements extending transversely across its lower surface and a plurality of support walls extending transversely across its upper surface. Each of the support walls is uniquely associated with and in substantial vertical alignment with one of the traction elements. In one embodiment, the traction elements include and angled lower wall and a substantially vertical rear wall. In this embodiment, the support walls may be in substantial vertical alignment with the rear wall. In another embodiment, the heel region includes an intersecting grid-like arrangement of support walls in its upper surface.

16 Claims, 6 Drawing Sheets

FOOTWEAR OUTSOLE

BACKGROUND OF THE INVENTION

The present invention relates to footwear and more particularly to an outsole for an article of footwear.

There is a continuing effort in the footwear industry to provide evermore comfortable and evermore durable footwear. In most applications, the design and construction of the outsole has a significant impact on the comfort and durability of the product. As a result of material properties, comfort and durability are typically competing interests. For example, more durable materials are typically denser result in heavier, less flexible and less comfortable soles. On the other hand, lighter materials generally provide improved comfort, but are less resistant to wear and can reduce the life of the product.

In an effort to improve both comfort and durability, some manufacturers use more durable outsole materials, but take steps to reduce the weight of the outsole. One known method for reducing the weight of an outsole is to define regions of relief in the upper surface of the outsole, for example, by forming cutouts or recesses in the upper surface. The weight of the outsole is reduced by the weight of the material that is removed. This method can dramatically reduce the overall weight of the outsole and consequently the shoe. Unfortunately, as material is removed from the upper surface of the outsole, the support provided by the outsole is dramatically reduced. In an effort to retain sufficient structural support in the outsole, a conventional relief pattern is configured to leave a grid-like arrangement of walls in the upper surface of the sole. Although this method improves the comfort of the outsole by providing a significant reduction in weight, the finished product remains substantially inflexible and does not provide the comfort desired in many applications.

SUMMARY OF THE INVENTION

The aforementioned problems are overcome by the present invention wherein an outsole includes a plurality of traction elements extending transversely across the undersurface of the sole and a plurality of corresponding support walls extending transversely across the upper surface of the sole. The outsole support walls are defined by a plurality of regions of relief and preferably do not intersect one another.

In one embodiment, the regions of relief extend down into the traction elements, thereby providing the traction elements with a somewhat hollow structure. In this embodiment, each upper support is vertically aligned with the rear wall of the corresponding traction element, thereby resulting in a substantially continuous vertical wall extending from the lowermost point in the traction element to the uppermost point in the outsole.

In one embodiment, each traction element is generally triangular in cross section with its height increasing toward the rear of the sole. In this embodiment, each traction element includes a rear wall that is vertically aligned with the corresponding support extending from the upper surface of the outsole.

In another embodiment, the traction elements undulate as they extend transversely across the sole. In this embodiment, the traction elements may be parallel to one another following a common series of undulations.

In yet another embodiment, the outsole includes a forefoot region and a heel region. The forefoot region includes a plurality of transversely extending, non-intersecting support walls, while the heel region includes a grid-work of intersection support walls.

The present invention provides a comfortable and lightweight, yet durable outsole. The transversely extending traction elements provide a relatively high degree of traction suitable for both indoor and outdoor use. At the same time, however, the transversely extending regions of relief dramatically reduce the weight of the outsole and dramatically improve flexibility. The triangular cross section of one embodiment provides that embodiment with enhanced traction characteristics. In those embodiments where the traction elements undulate across the outsole, the outsole provides enhanced support while continuing to provide be highly flexible. In those applications where the heel region includes a grid-like arrangement of walls, the outsole provides substantial support and limited flexibility in the heel region, while providing enhanced flexibility in the forefoot region.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
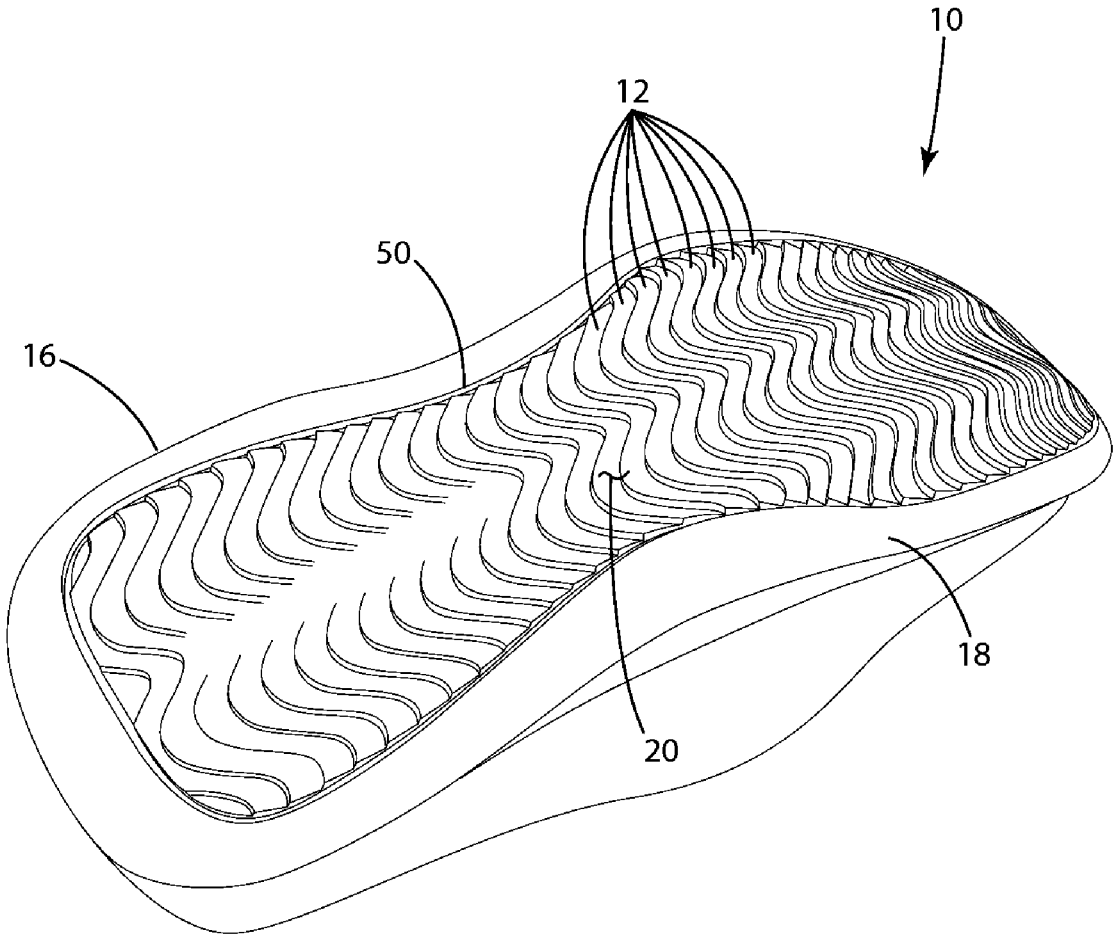
FIG. 1 is a bottom perspective view of an outsole in accordance with an embodiment of the present invention.
Figure 2:
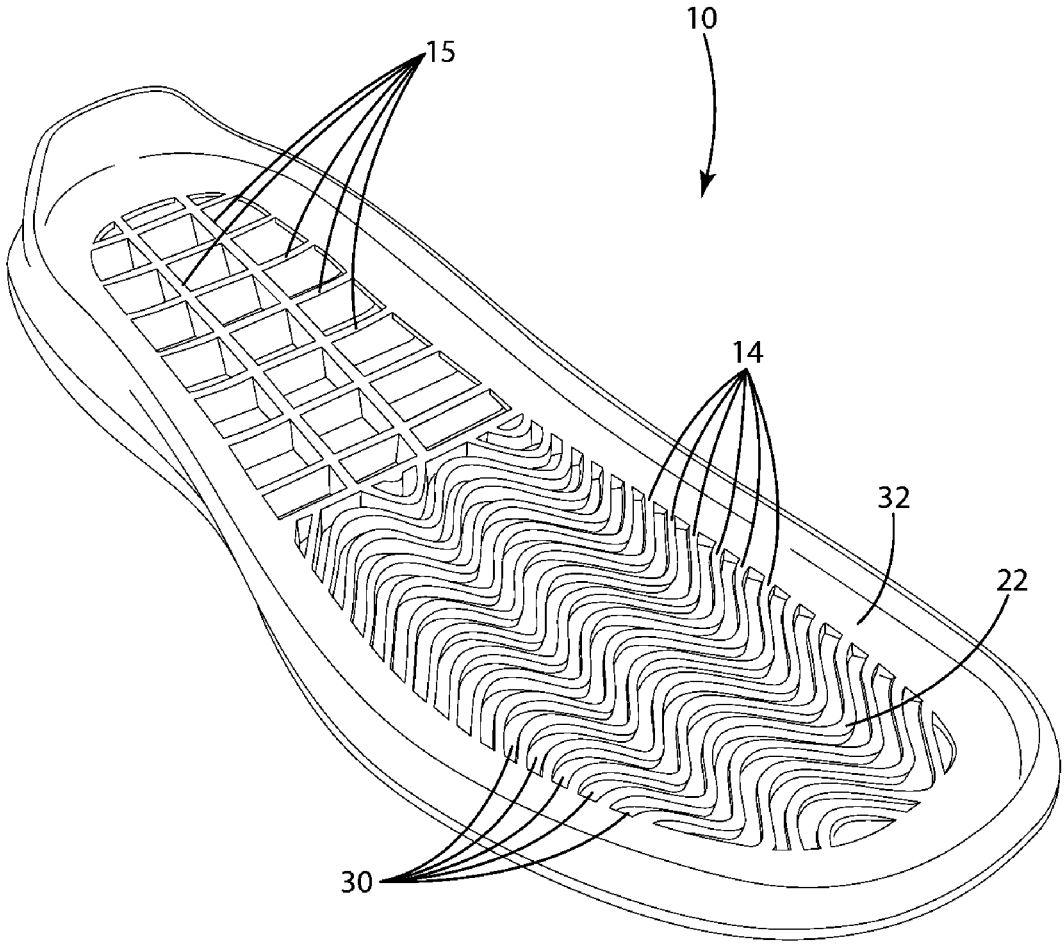
FIG. 2 is a top perspective view of the outsole.

An outsole according to one embodiment of the present invention is shown in FIGS. 1 and 2. As shown in FIG. 1, the outsole 10 includes a plurality of traction elements 12 that extend transversely across the undersurface of the sole 10. As shown in FIG. 2, the outsole 10 also includes a plurality of support walls 14 that extending transversely across the upper surface of the sole 10 corresponding with and following essentially the same line as the traction elements 12. The traction elements 12 and support walls 14 are in substantial vertical alignment so that there is an essentially continuous vertical wall from the ground contact surface to the upper surface of the outsole. The present invention is described in connection with an outsole intended to be secured to an upper using conventional techniques and apparatus.

Figure 3:
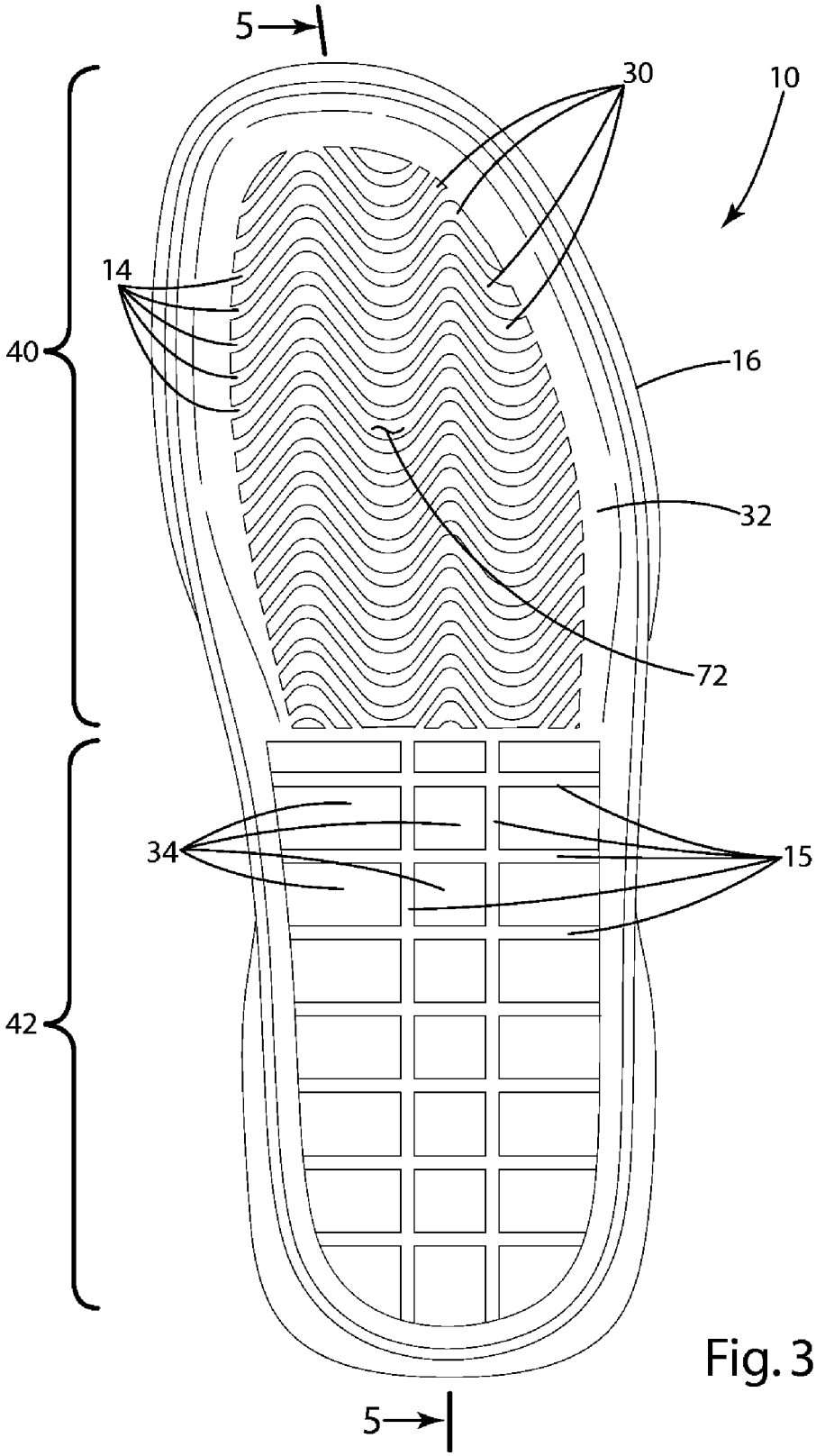
FIG. 3 is a top plan view of the outsole.
Figure 4:
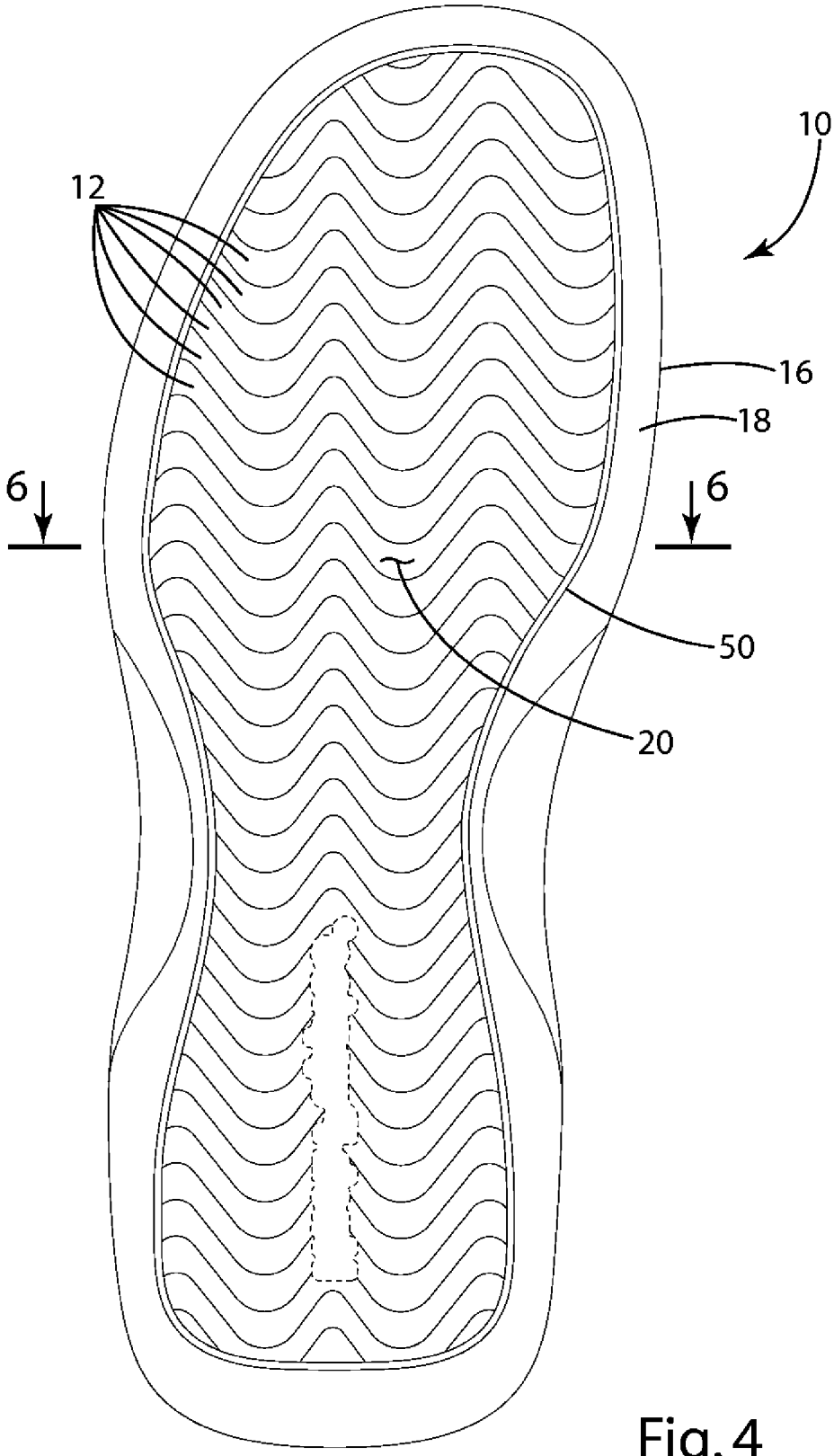
FIG. 4 is a bottom plan view of the outsole.

Referring now to FIGS. 3 and 4, the outsole 10 of the illustrated embodiment generally includes a main body 16 with an undersurface 20 having a marginal portion 18 and plurality of traction elements 12. As perhaps best shown in FIG. 4, the traction elements 12 extend substantially across the outsole 10 in a transverse or lateral direction. In the illustrated embodiment, the traction elements 12 terminate at peripheral groove 50 just short of marginal portion 18. The precise size, shape and width of the marginal portion 18 and the peripheral groove 50 may vary from application to application. In other embodiments, the marginal portion 18 and/or peripheral groove 50 may be eliminated. In the illustrated embodiment, the traction elements 12 may extend across substantially the entire undersurface 20 of the outsole 10 from the toe to the heel. Alternatively, the traction elements 12 may be disposed only in select regions. For example, the traction elements 12 may be located only in the forefoot region or only along the medial region of the outsole 10. In the described embodiment, the traction elements 12 are arranged in a regular, repeating pattern with traction elements 12 of essentially identical configuration arranged at a generally consistent spacing. In other embodiments, the traction elements 12 can be arranged in a non-repeating pattern and may be of varying configuration at different location within the outsole. For example, the traction elements 12 may be larger and/or have a greater depth in the forefoot region.

Figure 5:
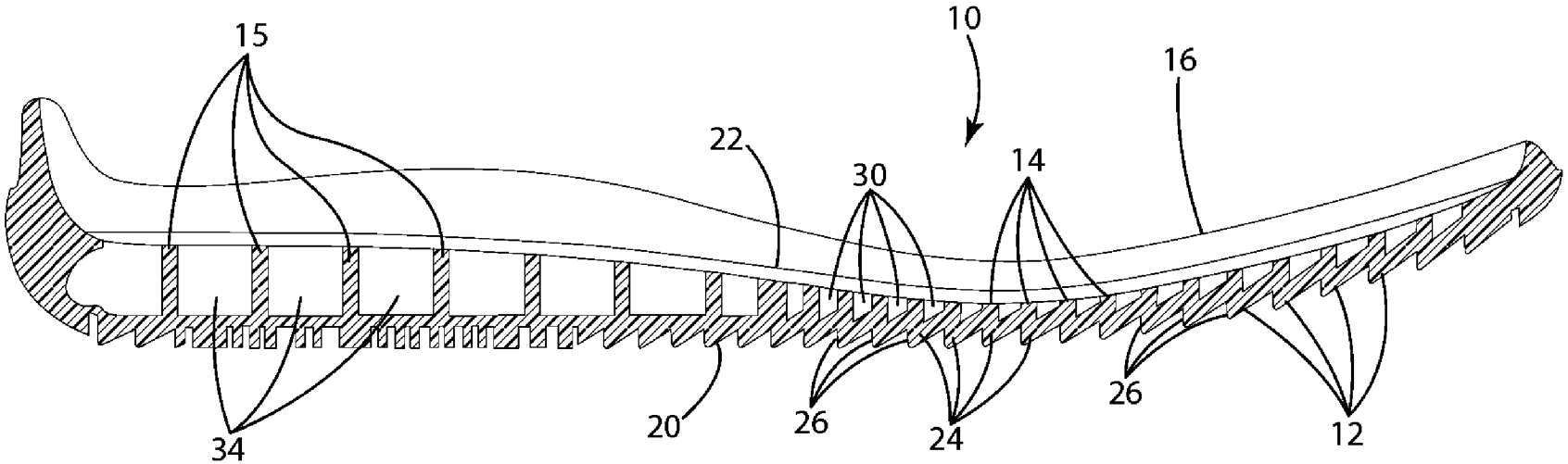
FIG. 5 is a sectional view of the outsole taken along line V-V of FIG. 2.
Figure 6:
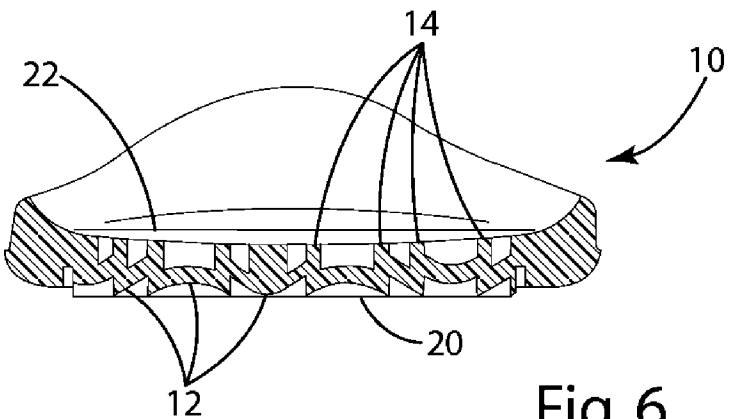
FIG. 6 is a sectional view of the outsole taken along line VI-VI of FIG. 2.

In the illustrated embodiment, the traction elements 12 are generally triangular in cross section and undulate as they cross the outsole 10. The number and magnitude of the undulations may vary from application to application depending in part on the desired balance between vertical support, longitudinal flexibility and weight relief. As shown in FIG. 5, the traction elements 12 generally include an angled lower wall 24 and a substantially vertical rear wall 26. The lower wall 24 may be uniform in thickness, as shown, or it may vary in thickness, for example, being tapered from top to bottom. Similarly, the thickness of the vertical rear wall 26 may be uniform or varying. As shown in FIG. 4, the traction elements 12 may be closely spaced with the angled lower wall 24 of one traction element 12 emerging from a line immediately adjacent to the vertical wall 26 of the preceding traction element 12. The size, shape (e.g. overall shape and cross sectional shape) and arrangement of the traction elements 12 may vary from application to application depending in part on the type environment in which the footwear will be worn.

The outsole 10 also includes an upper surface 22 having a marginal portion 32 and a plurality of support walls 14, 15. In the illustrated embodiment, the support walls 14 in the forefoot region 40 of the outsole 10 have a different configuration than the support walls 15 in the heel region 42. More specifically, the forefoot region 40 of the upper surface 22 defines a plurality of regions of relief 30 that extend transversely across the sole to, in turn, define the plurality of transversely extending support walls 14. In the heel region 42, the upper surface defines a plurality of square or rectangular regions of relief 34 that in turn define a grid-like pattern of intersecting support walls 15. In the illustrated embodiment, the marginal portion 32 of the upper surface 22 extends around the periphery of the outsole 10 and is somewhat wider than the marginal portion 18 of the undersurface 20, thereby resulting in support walls 14, 15 that are somewhat narrower in the transverse direction than the traction elements 12. The precise size, shape and width of the marginal portion 32 of the upper surface 22 may vary from application to application. In other embodiments, the marginal portion 32 of the upper surface 22 may be eliminated. In this embodiment, the support walls 14 in the forefoot region 40 are aligned with a corresponding traction element 12 and follow essentially the same line as the corresponding traction element 12. As perhaps best shown in FIG. 5, the support walls 14 in the forefoot region 40 are vertically aligned with the rear wall 26 of the traction elements 12. This vertical alignment provides an essentially continuous wall that extends from the lowermost point of the traction elements 12 to the upper surface 22 of the outsole 10 to provide the outsole 10 with enhanced support in the vertical direction. The transversely extending regions of relief 30 also provide the forefoot region 40 of the outsole 10 with enhanced flexibility in the longitudinal direction. Referring again to FIG. 5, the transversely extending regions of relief 30 extend down into the traction elements 12 following the angled lower wall 24.

The support walls 15 in the heel region 42 are arranged in an intersecting pattern of longitudinally extending and laterally extending support walls that provide substantially more rigidity than the transversely extending support walls 14 in the forefoot region 40. In the illustrated embodiment, the support walls 15 include seven transversely extending support walls 15 that are intersected by two longitudinally extending support walls 15. The number of longitudinal and transverse support walls 15 may vary from application to application depending in part on the desired rigidity and degree of weight relief. In the illustrated embodiment, the transversely extending support walls 14 cover the forefoot region 20 and transition into the intersection support walls 15 toward to front of the arch region of the outsole 10. The location of the transition from transverse to intersecting support walls may, however, vary from application to application. In applications where it is desirable to provide enhanced flexibility along the entire length of the sole, the intersecting support walls 15 can be eliminated and the transverse support walls 14 may extend throughout the forefoot region 40 and the heel region 42.

In the illustrated embodiment, the outsole 10 is manufactured from conventional outsole materials, such as latex rubber, EVA, TPU, polyurethane, rubber or TPR. The outsole 10 is formed using conventional injection molding machinery, but may be manufactured using other conventional techniques and apparatus. The outsole 10 is intended for incorporation into a wide variety of footwear soles using well-known techniques and apparatus. For example, the outsole 10 may be cemented directly to an upper. If desired, the outsole 10 can be combined with a midsole, inner sole or other conventional sole components.

Figure 7:
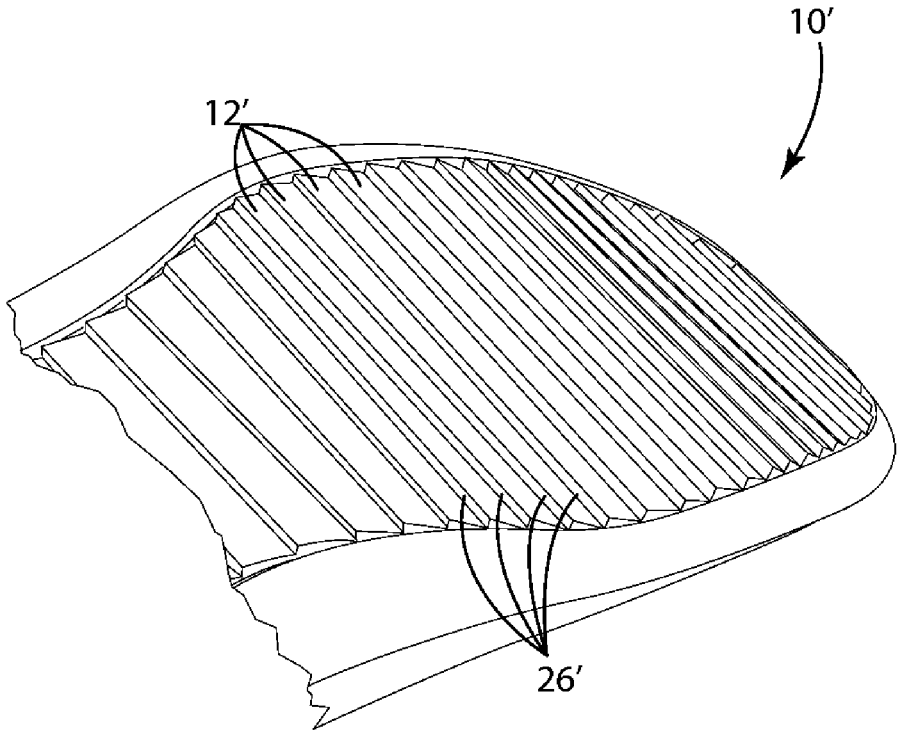
FIG. 7 is a bottom perspective view of an alternative outsole.

An alternative embodiment of the present invention is shown in FIG. 7. In this embodiment, the outsole 10' includes traction elements 12' that extend in a substantially straight line across the undersurface of the outsole 10'. In this embodiment, the support walls (not shown) in the forefoot region also extend in a substantially straight line across the outsole 10'. As with the above described embodiment, the support walls (not shown) are aligned with a corresponding traction element 12' and follow essentially the same line as the corresponding traction element 12'. The support walls in the forefoot region 40' may also be vertically aligned with the rear wall 26' of the traction elements 12'.

Figure 8:
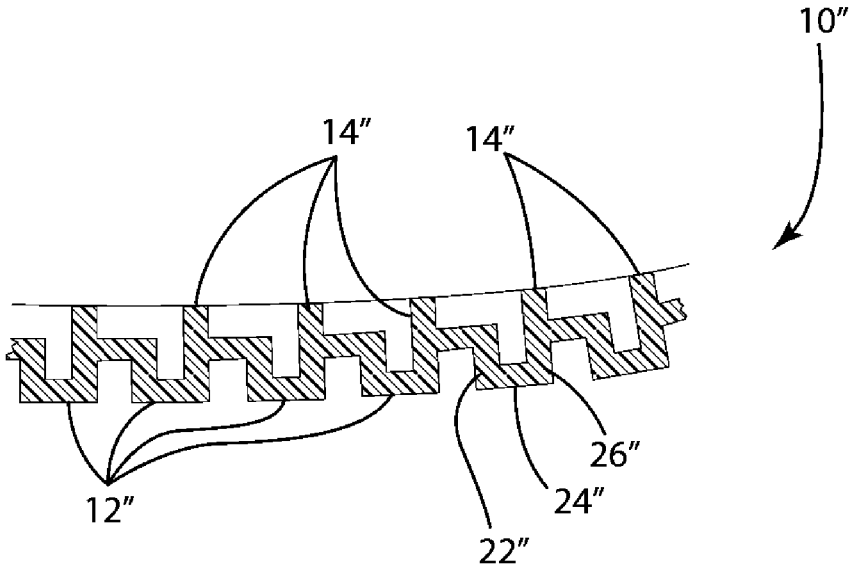
FIG. 8 is a bottom perspective view of a second alternative outsole.

A second alternative embodiment of the outsole 10" is shown in FIG. 8. In this embodiment, the traction elements 12" are generally rectangular in cross section having a front wall 22", lower wall 24" and rear wall 26". In this alternative embodiment, the support walls 14" are vertically aligned with the rear wall 26". Additionally (or in the alternative) the outsole 10" may includes a plurality of support walls (not shown) disposed in vertical alignment with the front wall 22". As a further alternative, the outsole 10" may include a plurality of support walls (not shown) that are of sufficient width so that a single support simultaneously overlays the rear wall 26" of one traction element and the front wall 22" of the immediately preceding traction element. As with the above described embodiment, the traction elements 12" and support walls 14" of this embodiment may undulate across the outsole 10."

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. An outsole for an article of footwear comprising:

a main portion having an upper surface and a lower surface;

a plurality of traction elements extending in a generally transverse direction substantially across said lower surface of said main portion, said traction elements including a rear wall and a lower wall that cooperate to define a generally triangular cross section, said lower wall having an upper surface and a lower surface, both said upper surface and said lower surface being angled with respect to a longitudinal extent of said main portion;

a first plurality of relief regions defined by said upper surface of said main portion, said relief regions extending in a generally transverse direction substantially across said upper surface, said relief regions being continuous and defining a plurality of nonintersecting and nonintersected transverse support walls extending in a generally transverse direction across said upper surface, said transverse support walls corresponding with and being in substantial vertical alignment with said rear wall of a corresponding one of said traction elements, said upper surface of said lower wall of said traction elements defining a bottom of said relief regions.

2. The outsole of claim 1 wherein said traction elements and said relief regions undulate across said main portion.

3. The outsole of claim 1 further comprising a second plurality of relief regions defined by said upper surface of said main portion, said second plurality of relief regions defining a plurality of intersecting support walls; and wherein said main portion includes a forefoot region and a heel region, said plurality of transverse support walls being disposed in said forefoot region and said plurality of intersecting support walls being disposed in said heel region.

4. The outsole of claim 3 further comprising a marginal portion extending around a periphery of said upper surface of said main portion, said marginal portion being free of said transverse support walls and said intersecting support walls.

5. The outsole of claim 4 wherein said transverse support walls are arranged in a repeating pattern.

6. The outsole of claim 5 further comprising a second marginal portion extending around a periphery of said lower surface of said main portion, said second marginal portion being free of said traction elements.

7. The outsole of claim 6 wherein said lower surface outsole defines a groove disposed between said second marginal portion and said traction elements.

8. An article of footwear comprising:

an upper;

a sole secured to said upper, said sole including an outsole having a plurality of traction elements extending in a generally transverse direction substantially across a lower surface of said outsole and a plurality of relief regions defined by an upper surface of said outsole, said relief regions extending in a generally transverse direction substantially across said upper surface, said traction elements including a rear wall and a lower wall that cooperate to define a generally triangular cross section, said lower wall being angled with respect to a longitudinal extent of said main portion, said relief regions being continuous and defining a plurality of nonintersected transverse support walls extending in a generally transverse direction across said upper surface, each of said transverse support walls corresponding with and being in substantial vertical alignment with said rear wall of a corresponding one of said traction elements, said lower wall of each said traction element defining a bottom of one of said relief regions, such that said relief regions each define a hollow region between said support walls and directly above said lower wall.

9. The article of footwear of claim 8 wherein each of said traction elements and said transverse support walls undulate across said outsole.

10. The article of footwear of claim 9 wherein said transverse support walls are arranged in a uniform, repeating pattern.

11. The article of footwear of claim 10 further comprising a marginal portion extending around a periphery of said upper surface of said outsole, said marginal portion being free of said transverse support walls.

12. The article of footwear of claim 11 further comprising a second marginal portion extending around a periphery of said lower surface of said outsole, said second marginal portion being free of said traction elements.

13. The article of footwear of claim 12 wherein said lower surface of said outsole defines a groove disposed between said second marginal portion and said traction elements.

14. The article of footwear of claim 13 further comprising a second plurality of relief regions defined by said upper surface of said outsole, said second plurality of relief regions defining a plurality of intersecting support walls; and wherein said outsole includes a forefoot region and a heel region, said plurality of transverse support walls being disposed in said forefoot region and said plurality of intersecting support walls being disposed in said heel region.

15. An outsole comprising: a forefoot region having an upper surface and a lower surface;

a heel region having an upper surface and a lower surface a plurality of traction elements undulating in a generally transverse direction substantially across said lower surface of said forefoot region, said traction elements including a rear wall and a lower wall that cooperate to define a generally triangular cross section, said lower wall having an upper surface and a lower surface, both said upper surface and said lower surface being angled with respect to a longitudinal extent of said main portion;

a plurality of relief regions defined by said upper surface of said forefoot region, said relief regions undulating in a generally transverse direction substantially across said upper surface of said forefoot region, said relief regions defining a plurality of nonintersecting and nonintersected transverse support walls extending in a generally transverse direction across said upper surface, said transverse support walls corresponding with and being in substantial vertical alignment with said rear walls of said plurality of traction elements, said upper surface of said lower wall of said traction elements defining a bottom of said relief regions.

16. The outsole of claim 15 further comprising a second plurality of relief regions defined by said upper surface of said heel region, said second plurality of relief regions defining a plurality of intersecting support walls in said upper surface of said heel region.

* * * * *